US010835951B2

(12) United States Patent
Rollinger et al.

(10) Patent No.: US 10,835,951 B2
(45) Date of Patent: Nov. 17, 2020

(54) METHOD FOR CREATING A NONPERMANENT MODEL

(71) Applicants: Safran, Paris (FR); Safran Aircraft Engines, Paris (FR)

(72) Inventors: Adrien Bernard Vincent Rollinger, Moissy-Cramayel (FR); Mathieu Jean Luc Vollebregt, Moissy-Cramayel (FR); Joseph Toussaint Tami Lizuzu, Moissy-Cramayel (FR); Vincent Marc Herb, Moissy-Cramayel (FR); Didier Maurice Marceau Guerche, Moissy-Cramayel (FR); Ramzi Bohli, Moissy-Cramayel (FR)

(73) Assignees: Safran, Paris (FR); Safran Aircraft Engines, Paris (FR)

( * ) Notice: Subject to any disclaimer, the term of this patent is extended or adjusted under 35 U.S.C. 154(b) by 0 days.

(21) Appl. No.: 16/320,666

(22) PCT Filed: Jul. 27, 2017

(86) PCT No.: PCT/FR2017/052126
§ 371 (c)(1),
(2) Date: Jan. 25, 2019

(87) PCT Pub. No.: WO2018/020182
PCT Pub. Date: Feb. 1, 2018

(65) Prior Publication Data

US 2019/0160524 A1 May 30, 2019

(30) Foreign Application Priority Data

Jul. 27, 2016 (FR) ..... 16 57229

(51) Int. Cl.
*B22C 9/10* (2006.01)
*B22C 9/24* (2006.01)
*B22C 21/14* (2006.01)

(52) U.S. Cl.
CPC ..... *B22C 9/103* (2013.01); *B22C 9/108* (2013.01); *B22C 9/24* (2013.01); *B22C 21/14* (2013.01)

(58) Field of Classification Search
CPC ..... B22C 9/103; B22C 9/108; B22C 9/24; B22C 9/10; B22C 21/14
See application file for complete search history.

(56) References Cited

U.S. PATENT DOCUMENTS 5,505,250 A * 4/1996 Jago ..... B22C 21/14 164/122.1
2013/0220571 A1 8/2013 Mueller et al.

FOREIGN PATENT DOCUMENTS

EP 2 777 841 A1 9/2014
EP 2 913 121 A1 9/2015
(Continued)

OTHER PUBLICATIONS

English machine translation of FR 2874187 (Year: 2006).*
international Search Report dated Oct. 25, 2017, in International Application No. PCT/FR2017/052126 (7 pages).

*Primary Examiner* — Kevin P Kerns
*Assistant Examiner* — Steven S Ha
(74) *Attorney, Agent, or Firm* — Bookoff McAndrews, PLLC

(57) ABSTRACT

The invention provides a method of assembling together a first core (12) and a second core (14) in order to make a non-permanent model configured for use in lost wax molding to form a part having a first cavity and a second cavity corresponding respectively to the first core and to the second core.

(Continued)

The invention is characterized by the fact that the first and second cores (12, 14) are assembled together with a first spacer (20), the first spacer (20) being arranged between the first and second cores.

19 Claims, 2 Drawing Sheets

(56) References Cited

FOREIGN PATENT DOCUMENTS

| | | | |
|---|---|---|---|
| FR | 2 874 187 | A1 | 2/2006 |
| WO | 2014/049223 | A2 | 4/2013 |
| WO | 2015/065727 | A1 | 5/2015 |

* cited by examiner

METHOD FOR CREATING A NONPERMANENT MODEL

CROSS-REFERENCE TO RELATED APPLICATIONS

This application is the U.S. national phase entry under 35 U.S.C. § 371 of International Application No. PCT/FR2017/052126, filed on Jul. 27, 2017, which claims priority to French Patent Application No. 1657229, filed on Jul. 27, 2016.

FIELD OF THE INVENTION

The present disclosure relates to a lost wax casting or molding process, and more particularly to a method of fabricating a non-permanent model that is used by way of example for forming sets of blades including a plurality of hollow cavities by means of a lost wax casting or molding process.

STATE OF THE PRIOR ART

Casting or molding processes of the lost wax type are well-known. They are particularly suitable for producing metal parts of complex shapes, e.g. for metal parts that present one or more cavities. Thus, lost wax casting is used in particular for producing turbine engine blades. By way of example, this method is described in Document WO 2014/049223.

In lost wax casting or molding, the first step normally consists in making a non-permanent model out of material having a comparatively low melting temperature, such as a wax or a resin, for example, with a mold, commonly referred to as a "shell mold", subsequently being overmolded on the model. After a step of removing the material of the non-permanent model from the inside of the mold, which may be referred to as "de-waxing", whence the name of this method, molten metal is cast into the mold in order to fill the volume that was previously occupied in the mold by the model before it was removed. Once the metal has cooled and solidified, the mold can be opened or destroyed in order to recover the metal part having the shape of the non-permanent model as made initially.

In order to fabricate a hollow object, those methods require the use of a part referred to as a "core" that serves to impart a shape to the inside of the hollow object. The outside surface of the core, which may for example be made of ceramic, thus forms the inside surface of the hollow object. An object is molded, injected, or cast around the core. Thereafter, the core needs to disappear during the method of fabricating the object, so as to leave a hollow volume inside the object. It can thus be understood that the core is the negative of the hollow object.

In the field of aviation, and in order to satisfy engine performance requirements, it is necessary to have blades that can withstand major mechanical and thermal stresses. To do this, one possibility consists in improving the cooling circuits of such blades, in particular by forming circuits that present a plurality of cavities arranged inside a blade.

In order to produce blades having a plurality of cavities by means of a lost wax casting process, use is made of a plurality of cores, and during the various steps of the casting process, it is important to guarantee the distances that separate them. In particular, at the time wax is injected for fabricating the non-permanent model there must be no change in the distances between the various cores, which determine the thicknesses of the various portions of the cooling circuit as formed in this way.

There therefore exists a need for a method of fabricating a non-permanent model that makes it possible to keep the various elements of the circuit in position relative to one another, without constraining them, in such a manner as to guarantee the thicknesses of metal in the resulting part and the positions of the various elements of the circuit relative to the functional portion of the part, e.g. when fabricating a blade.

SUMMARY OF THE INVENTION

To this end, the present disclosure provides a method of assembling together a first core and a second core in order to make a non-permanent model configured for use in lost wax molding to form a part having a first cavity and a second cavity corresponding respectively to the first core and to the second core, wherein the first and second cores are assembled together with a first spacer, the first spacer being arranged between the first and second cores.

The presence of the first spacer between the first and second cores thus serves to maintain the first distance between the first and second cores; the first core is configured to limit the effects of the pressure that would otherwise be exerted, in the absence of the first spacer, between the first and second cores while wax is being injected into the mold in which the first and second cores are arranged in order to fabricate the non-permanent model. In other words, the first spacer prevents wax from penetrating into the space defined between the first and second cores. Thereafter, the first spacer contributes to maintaining the first distance between the first and second cores, and thus serves to obtain a part in which the cavities comply with the looked-for dimensions. In order to maintain the first distance between the first and second cores by means of the first spacer, it can be understood that the first spacer contributes in particular to preventing the first and second cores from moving apart from each other, e.g. while wax is being injected into the mold, without the first spacer necessarily being directly in contact with one or the other of the first and second cores.

The term "spacer" is used to mean an element arranged between two parts, and that is configured to maintain a fixed spacing between those parts.

Thus, a spacer in the meaning of the present invention is directly adjacent to the parts between which it maintains the spacing.

The invention is set out below in a series of embodiment variants, which may be considered singly or in combination with one or more of the preceding variants.

In certain embodiments, the distance between the first and second cores is of the order of a few tenths of a millimeter.

In certain embodiments, the first spacer is made of a meltable material such as wax.

The term "meltable material" is used to mean a material that is meltable in the temperature ranges used for making a shell around the non-permanent model.

In certain embodiments, the meltable material forming the first spacer is configured to melt in a temperature range from 50° C. to 90° C., preferably from 55° C. to 80° C., and more preferably from 60° C. to 70° C.

In certain embodiments, the first spacer is configured to be eliminated during the de-waxing step.

Thus, the first spacer can be eliminated with the remainder of the non-permanent model in order to allow the object to be cast subsequently in the lost wax casting or molding process.

In certain embodiments, the first spacer presents a thickness less than the first distance, so as to define first gap between the first spacer and one of the first and second cores.

These provisions make it possible to maintain the first distance between the cores, while avoiding exerting any constraint on the cores.

In certain embodiments, the gap between the first spacer and one of the first and second cores lies in the range 0.01 millimeters (mm) to 0.35 mm, preferably in the range 0.03 mm to 0.30 mm, more preferably in the range 0.05 mm to 0.25 mm.

By the presence of the first gap between the first spacer and one of the first and second cores, the first spacer does not constrain the positioning of the first and second cores relative to each other, and does not compromise their positioning spaced apart at the first distance.

In certain embodiments, the first gap is dimensioned in such a manner as to prevent wax from penetrating into said space while wax is being injected.

In certain embodiments, the first gap is dimensioned as a function of the viscosity of the wax used for making the non-permanent model, so as to prevent wax from penetrating into said space while wax is being injected.

By way of example, the viscosity of a conventional wax used in lost wax molding processes is 15 pascal seconds (Pa·S) for the wax at a temperature of 70° C.

By this provision, the first spacer prevents the wax from penetrating into the space defined between the first and second cores, which could otherwise have the effect of modifying the arrangement of the first and second cores, and possibly also of damaging them. It can thus be understood that the dimensioning of the first spacer depends, in particular, on the characteristics of the wax used for making the non-permanent model, and more specifically on its viscosity.

In a first embodiment, the method further comprises a step in which the first spacer is fixed on one of the first and second cores.

In certain embodiments, the first spacer is fixed to one of the first and second cores by complementary shapes.

In certain embodiments, the surface(s) of the first and/or second cores is/are complex. The term "complex surface", is used to mean a surface that is not plane and/or that includes, by way of example, at least one cavity, at least one orifice, or indeed at least one protuberance.

In certain embodiments, the first spacer is configured to include at least one cavity, at least one orifice, and/or at least one protuberance, of shape complementary to at least a portion of the complex surface(s) of the first and/or second cores.

In certain embodiments, fixing is performed by means of adhesive or drilling.

Fixing the first spacer on one of the first and second cores ensures that the positioning of the first spacer is not modified, e.g. while the assembly is being inserted into a mold, or while wax is being injected into said mold. Such movements of the first spacer could also give rise to constraints on the first and second cores, which could lead to them being degraded.

In certain embodiments, the first spacer includes a first spacer element arranged between the first and second cores and configured to maintain the position of the first spacer relative to the first and second cores.

The first spacer element is arranged in an out-of-part zone, i.e. in a zone that is not used for molding the final part and/or that is separated from the final part after molding and/or that does not remain in the final metal part. The zone that is used for molding the final part and/or that is not separated from the final part after molding and/or that remains in the final metal part is referred to in the present disclosure by the term "working zone".

The working zone contains the assembly of the working portions of the first and second cores and of the first spacer.

Specifically, instead of fixing the first spacer together with the first and second cores in the working zone, it is possible to assemble the first spacer element and the first and second cores together in the out-of-part zone.

This embodiment may be an alternative to or in addition to the embodiment in which the first spacer is fixed to one of the first or second cores in the working zone.

In certain embodiments, the non-permanent model is configured for use in lost wax molding to form a part that also includes a third cavity, corresponding to a third core.

In certain embodiments, the method includes a step of assembling a third a core and a second spacer with the first and second cores, the second spacer being arranged between the first and third cores.

In certain embodiments, the first, second, and third cores are assembled with a first spacer arranged between the first and second cores, and with a second spacer arranged between the first and third cores.

By this provision, it is possible to form a part that presents at least three cavities.

The characteristics relating to the first spacer are applicable to the second spacer.

The characteristics relating to the first and second cores are applicable to the third core.

In certain embodiments, the third core with a second spacer is assembled after the step of assembling the first and second cores with the first spacer.

In certain embodiments, the third core with the second spacer is assembled simultaneously with the step of assembling the first and second cores with the first spacer.

In certain embodiments, the second spacer has a second spacer element, the first and second spacer elements being configured to be assembled together in the out-of-part zone.

In certain embodiments, the first and second spacer elements are configured for being assembled together by complementary shapes.

In certain embodiments, the first and second spacer elements are arranged in an out-of-part zone.

In certain embodiments, the first core has a first out-of-part portion.

In certain embodiments, the first out-of-part portion includes an assembly opening.

In certain embodiments, the assembly opening has first and second bearing edges.

In certain embodiments, the second core includes a second out-of-part portion.

In certain embodiments, the third core includes a third out-of-part portion.

In certain embodiments, the method comprises:

- a step during which the first spacer element is placed level with a first bearing edge of an assembly opening in the first out-of-part portion; and
- a step during which the second spacer element is placed between the first spacer element and a second bearing edge of the assembly opening in the first out-of-part portion.

The use of the first and second spacer elements serves both to facilitate putting the first and second spacers into place between the first and second cores and also between the first and third cores, and also to maintain their arrangements during subsequent steps of the lost wax casting or molding process.

In certain embodiments, the first spacer element is arranged between the first and second cores so as to present at least a first point of contact with the first core.

In certain embodiments, the first spacer element presents a plurality of points of contact with the first core.

Thus, the accuracy with which the first spacer element is put into place is improved, as is the stability of the assembly made up of the first core and the first spacer element.

In certain embodiments, the first and second spacer elements are configured so as to be fixed relative to each other in at least one direction.

This provision further improves maintaining the positioning of the first and second spacer elements, and consequently maintaining the first distance between the first and second cores.

In certain embodiments, the first and second spacer elements are fixed to each other.

In certain embodiments, the first and second spacer elements are fixed to each other by adhesive or by welding.

Fixing the first and second spacer elements to each other contributes to the accuracy with which the first spacer is mounted between the first and second cores, without it being necessary to fix the first spacer to at least one of the first and second cores.

In certain embodiments, the first spacer element includes a first housing configured to receive the second core.

In certain embodiments, the second spacer element includes a second housing configured to receive the third core.

BRIEF DESCRIPTION OF THE DRAWINGS

The invention and its advantages can be better understood on reading the following detailed description of various embodiments of the invention given as nonlimiting examples. The description makes reference to the sheets of accompanying figures, in which.

DETAILED DESCRIPTION OF EMBODIMENTS

Figure 1:
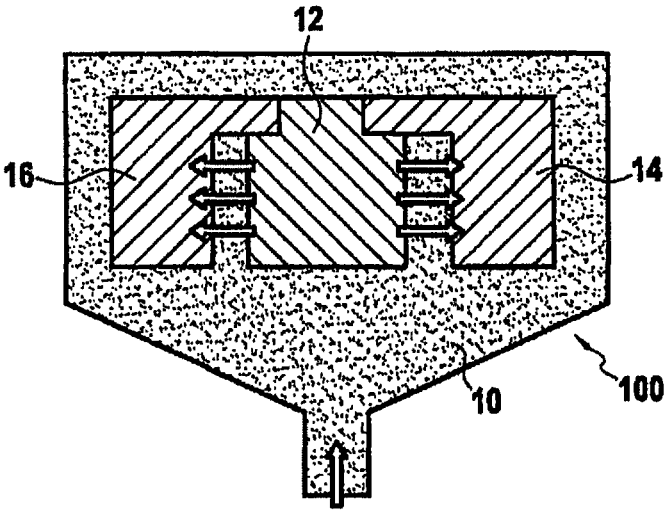
FIG.1 PRIOR ART
FIG. 1 is a diagram showing a step of injecting wax in order to make a non-permanent model in the prior art.

FIG. 1 is a diagram showing how a non-permanent model is made in the prior art for use in a lost wax casting or molding process in order to fabricate a part that presents first, second, and third cavities. To do this, use is made of first, second, and third cores 12, 14, and 16, e.g. made of ceramic type material.

With reference to the arrangement of the corresponding cavities in the blade that is to be formed from the non-permanent model made by the assembly of the first, second, and third cores 12, 14, and 16, those cores may be referred to respectively as the central core, the suction side core, and the pressure side core.

In the known prior art method, the first, second, and third cores 12, 14, and 16 are assembled to one another prior to being arranged in a wax injection mold 100.

In order for it to be possible to assemble the cores without impacting the cooling circuit that is to be present inside the resulting part at the end of the lost wax casting process, the cores 12, 14, and 16 are assembled to one another in "out-of-part" zones, i.e. in the zones that are eliminated from the final blade.

As shown in FIG. 1, while wax 10 is being injected into the wax injection mold 100, with the injection usually being performed at high pressure, large forces, as symbolized by horizontal arrows in FIG. 1, become applied between the cores 12, 14, and 16 in such a manner that the distances between the various cores run the risk of being modified; during this high-pressure injection and as a result of these large forces, there is also a risk of the cores 12, 14, and 16 being degraded or even broken.

Figure 2A:
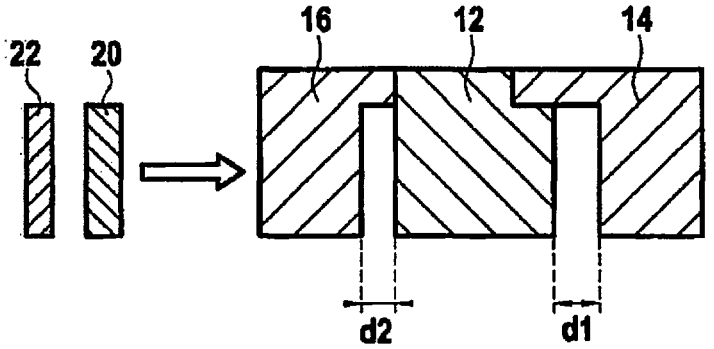
FIGS. 2A, 2B, and 2C are diagrams showing the various steps of a method of fabricating a non-permanent model in a first embodiment of the present invention.
Figure 2B:
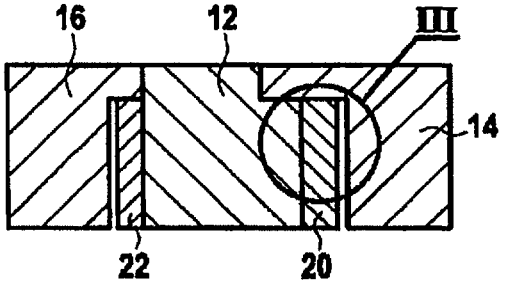
Figure 2C:
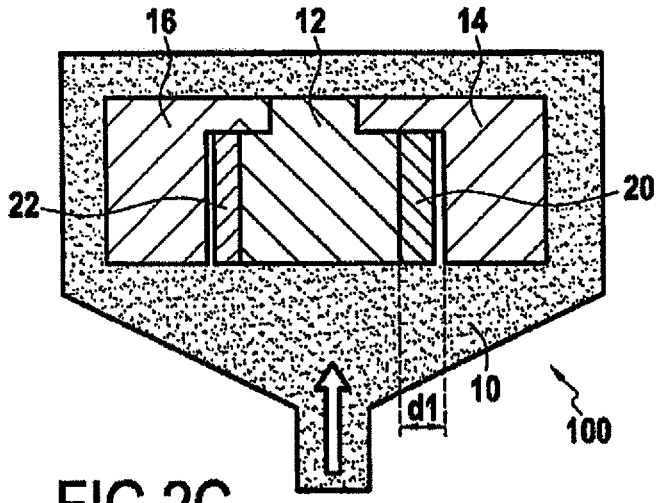

FIGS. 2A, 2B, and 2C are diagrams showing the various steps of a method of fabricating a non-permanent model in a first embodiment of the present invention.

As shown in FIG. 2A, the first, second, and third cores 12, 14, and 16 are arranged in such a manner that a first distance d1 lies between the first and second cores 12 and 14, and a second distance d2 lies between the first and third cores 12 and 16.

In the method of the present invention, first and second spacers 20 and 22 are provided which have dimensions enabling them to be placed respectively between the first and second cores 12 and 14, and between the first and third cores 12 and 16.

For reasons of clarity, FIG. 2A shows the assembly of the first, second, and third cores 12, 14, and 16 prior to putting the first and second spacers 20 and 22 into place, so as to show the distances d1 and d2 between the cores. The method of the present invention is naturally not restricted to assembling the spacers 20 and 22 after the cores 12, 14, and 16 have been assembled together, and it also covers simultaneously assembling together all or some of the cores 12, 14, and 16 with all or some of the spacers 20 and 22.

For example, and in nonlimiting manner, the first and second spacers 20 and 22, and also the first and second spacer elements 24' and 26' of the first and second spacers 20 and 22 (which elements are described below with reference to the second embodiment of the method of the present invention) are made of a meltable material such as wax, resin, polymer, . . . . By way of example, the first and second spacers 20 and 22 may be formed using an injection method or a method of the additive manufacturing type.

The term "meltable material" is used to mean a material that is meltable in the temperature ranges used for making a shell around the non-permanent model.

The meltable material forming the first spacer is configured to melt in a temperature range from 50° C. to 90° C., preferably from 55° C. to 80° C., and more preferably from 60° C. to 70° C.

The first spacer is configured to be eliminated during the de-waxing step.

In order to facilitate manipulating the first and second spacers 20 and 22, they may also be formed using a wax that presents advantageous flexibility properties.

By way of example and in nonlimiting manner, the first and second spacers 20 and 22 are in the shape of plates presenting respective first and second widths e1 and e2. In this example, the plates are curved. The term "in the shape of plates" is used herein to mean shapes of thicknesses that are small relative to their lengths or their widths.

Figure 3:
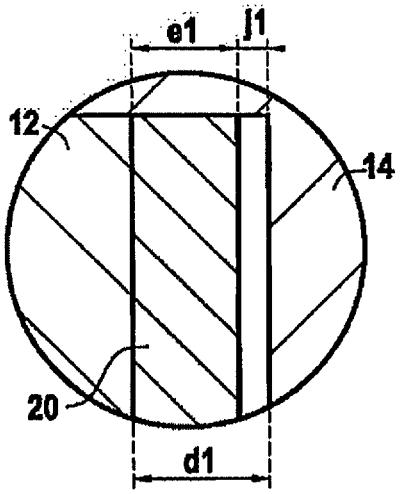
FIG. 3 is a diagram showing a detail of how the first and second cores are assembled by means of the first spacer in the first embodiment of the present invention.

As shown in FIG. 3, the first spacer 20 is of dimensions such that its thickness e1 is less than the first distance d1 between the first and second cores 12 and 14; in other words, the first spacer 20 is of dimensions such that gap j1 is formed between the first spacer 20 and one of the first and second cores 12 and 14, specifically the second core 14, when the first spacer 20 is placed between said cores 12 and 14.

The gap between the first spacer and one of the first and second cores lies in the range of 0.01 mm to 0.35 mm, preferably in the range of 0.03 mm to 0.30 mm, preferably in the range of 0.05 mm to 0.25 mm.

The characteristics that apply to the first gap j1 between the first and second cores 12 and 14 also apply to second gap between the first and third cores 12 and 16.

The second gap is formed between the second spacer 22 and one of the first and third cores 12 and 16, specifically between the second spacer 22 and the third core 16.

The presence of such gaps serves to ensure that inserting the first and second spacers 20 and 22 between the corresponding cores does not constrain the relative position of said cores.

By way of example and in nonlimiting manner, the first and second spacers 20 and 22 are fixed by adhesive or by any other fixing method to one of the spacers between which they are arranged; specifically, the first and second spacers 20 and 22 are both fixed to the first core 12.

The first and second spacers 20, 22 may also be fixed to the first core 12 by complementary shapes.

By way of example, the first core 12 has a surface that is complex. The first core 12 may include at least one cavity, at least one orifice, or indeed at least one protuberance, and the second spacer 20 may include at least one cavity, at least one orifice, and/or at least one protuberance of shape that is complementary to at least a portion of the surface of the first and/or second core.

As shown in FIG. 3, the assembly comprising the cores 12, 14, and 16 together with the spacers 20 and 22 is then placed in the wax injection mold 100, into which wax 10 is injected, generally under high pressure, in order to form the non-permanent model.

As can be seen in FIG. 2C, the first and second gaps j1 and j2 are given dimensions such that the wax 10, given in particular its viscosity, is prevented from penetrating into the spaces formed either between the second spacer 20 and the second core 14, or else between the second spacer 22 and the third core 16.

The dimensions of the first and second gaps are determined as a function of the viscosity of the wax used for making the non-permanent model so as to prevent wax from penetrating into said space while wax is being injected.

By way of example, the viscosity of a conventional wax used in lost wax molding processes is 15 Pa·s for the wax at a temperature of 70° C.

Thus, the presence of the first and second spacers 20 and 22 limits any risk of the cores moving relative to one another, and also any risk of said cores deteriorating while the wax 10 is being injected into the wax injection mold 100.

It should be observed that the fact that the above-described gaps are not filled in with wax 10 while the wax 10 is being injected into the wax injection mold 100 does not compromise the integrity and the dimensional accuracy of the part that is to be formed from the non-permanent model, insofar as the metal for forming the part is cast only after the wax 10 has been eliminated, which may be referred to as "de-waxing".

It can be understood that the shape and the dimensioning of the first and second spacers 20 and 22 depend on the characteristics of the cavities that are to be formed in the part that is to be made, and more particularly on the way they are arranged relative to one another, and consequently on the characteristics of the cores 12, 14, and 16 between which the spacers are configured to be located.

Figure 4A:
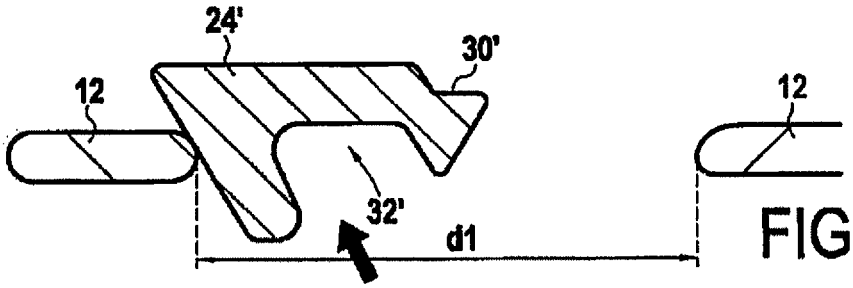
FIGS. 4A and 4B are diagrams showing how the first and second cores are assembled in a second embodiment of the present invention.
Figure 4B:
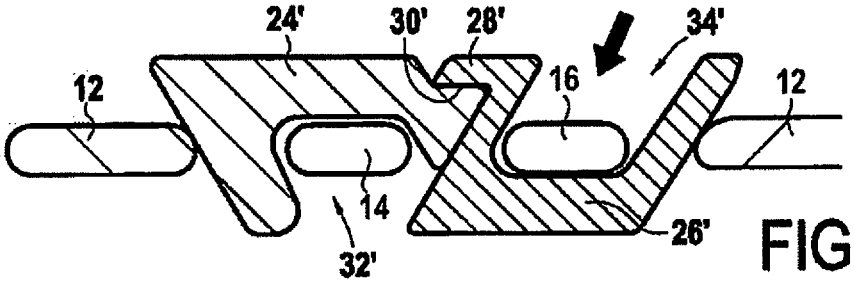

FIGS. 4A and 4B are diagrams showing how the first, second, and third cores 12, 14, and 16 are assembled in the out-of-part zone in an alternative or additional, second embodiment of the present invention.

More particularly, FIGS. 4A and 4B are diagrams showing how a first spacer element 24' of the first spacer 20 and a second spacer element 26' of the second spacer 22 are arranged with the first, second, and third cores 12, 14, and 16.

Unlike FIGS. 2A to 2C, which are section views of the set of cores 12, 14, and 16 in a working zone corresponding to the part that is to be obtained at the end of the lost wax casting or molding process, FIGS. 4A and 4B are diagrams showing section views of the set of first, second, and third cores 12, 14, 16 in an out-of-part zone in which they are fastened to one another.

The first spacer 20 has a first spacer element 24' and the second spacer 22 has a second spacer element 26', which elements are configured to cooperate with each other so as to maintain the respective distances dl and d2 between the first and second cores 12 and 14 and between the first and third cores 12 and 16.

The first and second spacer elements are 24' and 26' are arranged in an out-of-part zone.

Specifically, instead of, or as well as, fixing together the first and second spacer elements 24' and 26' and the first, second, and third cores 12, 14, and 16 in the working zone, it is possible to assemble together the first and second spacer elements 24' and 26' and the first, second, and third cores 12, 14, and 16 in the out-of-part zone.

The first and second spacer elements 24' and 26' are configured for being assembled together by complementary shapes.

The first core 12 has a first out-of-part portion. The first out-of-part portion includes an assembly opening. The assembly opening has first and second bearing edges.

The second and third cores 14 and 16 have respective second out-of-part portions. As shown in FIG. 4A, the method in this second embodiment begins with a step in which the first spacer element 24' is placed against the first bearing edge of an assembly opening in the first out-of-part portion between the first edge and a second bearing edge of the assembly opening of the first core 12. Positioning is ensured by the presence of at least one point of contact between the first spacer element 24' and the first bearing edge of the first core 12. Said at least one point of contact is reached, for example and in nonlimiting manner, when the first spacer element 24' is moved along the direction symbolized by the arrow shown in FIG. 4A. In order to ensure that the positioning of the first spacer element 24' is stable relative to the first core 12, a plurality of points of contact may be reached, which points are arranged on the body of the first core 12 along a direction that extends transversely to the section plane shown diagrammatically in FIGS. 4A and 4B.

Thereafter, in this second embodiment, the method has a step during which the second spacer element 26' of the second spacer 22 is placed between the first spacer element 24' and the second bearing edge of the core 14, e.g. by being moved in the direction symbolized by the arrow shown in FIG. 4B. During this step, the first and second spacer elements are assembled together by complementary shapes.

Once assembled, the surfaces in contact with the first and second bearing edges of the first and second spacer elements converge, downwards in FIG. 4B.

As can be seen in FIG. 4B, the second spacer element 26' includes a fixing device 28' that, by way of nonlimiting example, is in the form of a lug configured to cooperate with a flat 30' formed on the first spacer element 24'. It can be understood that by fixing the fixing device 28' of the second spacer element 26' against the first spacer element 24', e.g. against its flat 30', relative movement between the first and second spacers 20 and 22 is prevented in the section plane shown diagrammatically in FIGS. 4A and 4B.

Figure 5:
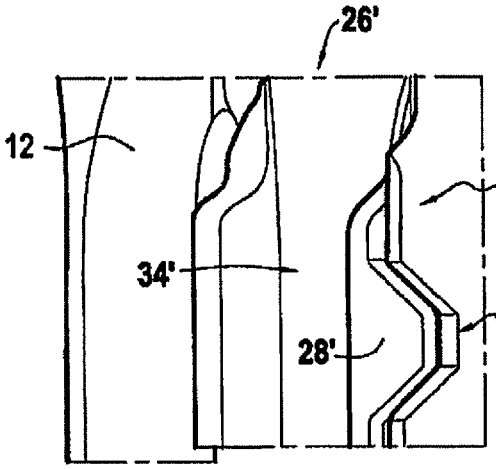
FIG. 5 is a diagram showing a detail of how the first and second spacer elements are assembled in the second embodiment.

In addition, the first and second spacer elements 24' and 26' are blocked relative to each other in a direction substantially perpendicular to the section plane shown diagrammatically in FIGS. 4A and 4B, and as shown in FIG. 5, by the fixing device 28' co-operating with a notch 36' formed in the first spacer element 24', where FIG. 5 is a diagrammatic detail of the assembly between the first and second spacer elements 24' and 26' in a plane substantially perpendicular to the plane of FIGS. 4A and 4B. FIG. 4B is a section view of FIG. 5 on a plane arranged at the level of the fixing device 28'.

It can thus be understood that the first spacer 20 is shaped in such a manner that the first and second spacer elements 24' and 26' have no degree of freedom to move relative to each other after the fixing device 28' has been fixed against the first spacer element 24'. A fixing device 28' of any other shape could be devised.

Without going beyond the ambit of the present invention, it would naturally be possible to devise first and second spacer elements 24' and 26' shaped in such a manner as to allow at least one degree of freedom to move between said elements, so as to enable gap to be created between the first and second spacers 20 and 22 and the first core 12. By way of example, such freedom to move could be achieved by eliminating the fixing device 28' formed on the second spacer element 26'.

Once more, and for reasons of clarity, one particular sequential representation of the method of the present invention is given above, however, and without going beyond the ambit of the present invention, it is just as possible to devise a method performed in a different order, or indeed a method in which all or some of the first and second spacer elements 24' and 26' and all or some of the first core 12 are assembled together in simultaneous manner.

Furthermore and by way of nonlimiting example, the first and second spacer elements 24' and 26' define respective housings 32' and 34' that are configured to receive the second and third cores 14 and 16, respectively. The housings 32' and 34' are shaped in such a manner that gap is created between the second and third cores 14 and 16 arranged in said housings 32' and 34' and the corresponding spacer element so that the arrangement of said cores relative to said first and second spacer elements 24' and 26' is not constrained. Thereafter, the presence of gaps between the second and third cores and the respective spacer elements is configured to avoid constraining the arrangement of the first core 12.

The first and second spacer elements 24' and 26' are thus shaped in such a manner as to be arranged easily and without special tooling between the first, second, and third cores 12, 14, and 16, while ensuring stability for the distances separating said cores from one another.

In the example shown in the figures relating to the second embodiment, cooperation between the first and second spacer elements 24' and 26' takes place over end portions of said elements, e.g. over root portions of said elements, such that the spacer elements 24' and 26' present sections that vary along their longitudinal directions.

The cores 12, 14, and 16 may be parts that are distinct, or they may be constituted by distinct branches of a common core. In other words, without going beyond the ambit of the present invention, it is possible to devise an assembly method in which all or some of the first, second, and third cores 12, 14, and 16 are connected to one another. Also, the present invention is naturally not limited to assembling three cores with two spacers.

It can thus be understood that the use of spacers makes it possible to ensure that the cores are arranged relative to one another for the purpose of forming a non-permanent model without requiring the structure of said cores to be modified.

The spacers may also include cooperation means, such as grooves, that are configured to cooperate with one of the cores, for the purposes, among others, of reinforcing the spacer and of improving the stability with which the spacer is positioned relative to said core.

Although the present invention is described with reference to specific embodiments, it is clear that various modifications and changes may be undertaken on those embodiments without going beyond the general ambit of the invention as defined by the claims. In particular, individual characteristics of the various embodiments mentioned above may be combined in additional embodiments. Consequently, the description and the drawings should be considered in a sense that is illustrative rather than restrictive.

It is also clear that all of the characteristics described with reference to a method can be transposed, singly or in combination, to a device, and vice versa, all of the characteristics described with reference to a device can be transposed, singly or in combination to a method.

The invention claimed is:

1. A method of assembling together a first core and a second core in order to make a non-permanent model configured for use in lost wax molding to form a part having a first cavity and a second cavity corresponding respectively to the first core and to the second core, wherein the first and second cores are assembled together with a first spacer, the first spacer being arranged between the first and second cores, wherein the first and second cores are separated by a first distance, wherein the first spacer presents a thickness less than the first distance, so as to define a first gap between the first spacer and one of the first or second cores, and wherein the first gap is dimensioned in such a manner as to prevent wax from penetrating into a space defined between the first and second cores while wax is being injected.

2. The method according to claim 1, wherein the first spacer includes a meltable material.

3. The method according to claim 1, wherein the first gap is dimensioned as a function of a viscosity of wax used for making the non-permanent model.

4. The method according to claim 1, wherein the gap between the first spacer and one of the first or second cores lies in the range 0.01 mm to 0.35 mm.

5. The method according to claim 1, further comprising a step in which the first spacer is fixed on one of the first or second cores.

6. The method according to claim 1, wherein the gap between the first spacer and one of the first or second cores lies in the range 0.03 mm to 0.30 mm.

7. The method according to claim 1, wherein the gap between the first spacer and one of the first or second cores lies in the range 0.05 mm to 0.25 mm.

8. The method according to claim 1, wherein the first spacer includes wax.

9. The method according to claim 1, wherein the first spacer is fixed on one of the first or second cores.

10. The method according to claim 9, wherein the first spacer is fixed to the one of the first or second cores via complementary shapes.

11. The method according to claim 1, wherein one or more of the first or second cores includes at least one complex surface.

12. The method according to claim 11, wherein the first spacer includes one or more of a cavity, an orifice, or a protuberance that, in each case, has a shape complementary to at least a portion of the at least one complex surface.

13. A method of assembling together a first core and a second core in order to make a non-permanent model configured for use in lost wax molding to form a part having a first cavity and a second cavity corresponding respectively to the first core and to the second core, wherein the first and second cores are assembled together with a first spacer, the first spacer being arranged between the first and second cores, wherein the first spacer includes a first spacer element arranged between the first and second cores and configured to maintain the position of the first spacer relative to the first and second cores, and wherein the first spacer element includes a first housing configured to receive the second core.

14. The method according to claim 13, wherein the first spacer element is arranged between the first core and the second core so as to present at least a first point of contact with the first core.

15. A method of assembling together a first core and a second core in order to make a non-permanent model configured for use in lost wax molding to form a part having a first cavity and a second cavity corresponding respectively to the first core and to the second core, wherein the first and second cores are assembled together with a first spacer, the first spacer being arranged between the first and second cores, wherein the method further includes a step of assembling a third core and a second spacer with the first and second cores, the second spacer being arranged between the first and third cores, and wherein the second spacer has a second spacer element, the first and second spacer elements being configured to be assembled together in an out-of-part zone.

16. The method according to claim 15, wherein the first and second spacer elements are configured for being assembled together by complementary shapes.

17. The method according to claim 15, wherein the first and second spacer elements are configured so as to be fixed relative to each other in at least one direction.

18. The method according to claim 15, wherein the first and second spacer elements are fixed to each other.

19. The method according to claim 15, wherein the second spacer element includes a second housing configured to receive the third core.

* * * * *